US005115939A

United States Patent [19]

Porter

[11] Patent Number: 5,115,939

[45] Date of Patent: May 26, 1992

[54] INSULATED BEVERAGE CONTAINER

[76] Inventor: Kirby H. Porter, 6816 Montauk Dr., Richmond, Va. 23225

[21] Appl. No.: 751,124

[22] Filed: Aug. 28, 1991

[51] Int. Cl.[5] ..... B65D 11/00; A47J 41/00

[52] U.S. Cl. ..... 220/705; 220/703; 220/739

[58] Field of Search ..... 220/705-710, 220/703, 737, 738, 739

[56] References Cited

U.S. PATENT DOCUMENTS 3,533,529 10/1970 Helbig ..... 220/705

4,462,544 7/1984 Rutzel et al. ..... 220/705

4,671,424 6/1987 Byrns ..... 220/739

4,708,254 11/1987 Byrns ..... 220/739

4,813,558 3/1989 Fujiyoshi ..... 220/739

*Primary Examiner*—Joseph Man-Fu Moy

[57] ABSTRACT

An insulated shielded beverage carrier includes an insulated sleeve for housing a beverage container therein, a support housing for receiving the insulated beverage, and an umbrella supported by and anchored to the support housing for shading the insulated beverage from harmful heating effects of the sun.

7 Claims, 3 Drawing Sheets

INSULATED BEVERAGE CONTAINER

BACKGROUND OF THE INVENTION

The present invention relates to an insulated and stabilized beverage container, and particularly to an insulated and stabilized beverage container which is shielded from the sun by an umbrella provided therewith.

DESCRIPTION OF RELATED ART

Heretofore, insulated beverage containers have been known in which a beverage of a can or bottle type is housed within an insulated sleeve or similar insulated beverage container carrier. These types of devices are often times unsatisfactory since when used out of doors sun light will heat the contents of the can or bottle due to the upper portion of the can or bottle begin exposed from the insulated sleeve. If a can or the like is entirely housed within an insulated sleeve, then it is necessary to remove the can therefrom in order to consume the beverage. Further the consumer is often relaxing or even lying down when enjoying a beverage, and the beverage must constantly be picked up in order to consume the same, even when it is housed within an insulated sleeve. Accordingly, the present invention overcomes these problems found in the art by providing an insulated beverage container which is shaded from sun and other external factors, and is easier to consume even in a reclining position.

SUMMARY OF THE INVENTION

Accordingly, it is a primary object of the present invention to provide a beverage carrier which is shielded from the sun or external weather factors.

It is a further object of the present invention to provide a beverage carrier shielded from the sun, and wherein the beverage housed therein is consumable when a user is in a reclining position.

The objects of the present invention are fulfilled by providing a shielded beverage carrier comprising:

- an insulated sleeve for accommodating a beverage receptacle therein;
- a support housing for receiving the insulating sleeve therein, the support housing including an inner wall corresponding to an exterior shape of the insulated sleeve; and
- an umbrella anchored to the support housing.

The support housing is pleasing in appearance and stable in configuration so that the same may be placed adjacent to the user without fear of overturning the same, even when a beverage therein is being consumed.

Further, the shielding member or umbrella attached to the support housing is rotatably and angularly adjustable between any number of positions in order to block the sun from the support housing at all times.

Further, the beverage carrier is adaptable to fit within a floatation device for use in an aquatic environment, the floatation device also providing added stability to prevent tipping of the support housing under most circumstances.

Further scope of applicability of the present invention will become apparent from the detailed description given hereinafter. However, it should be understood that the detailed description and specific examples, while indicating preferred embodiments of the invention are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENTS

Figure 1:
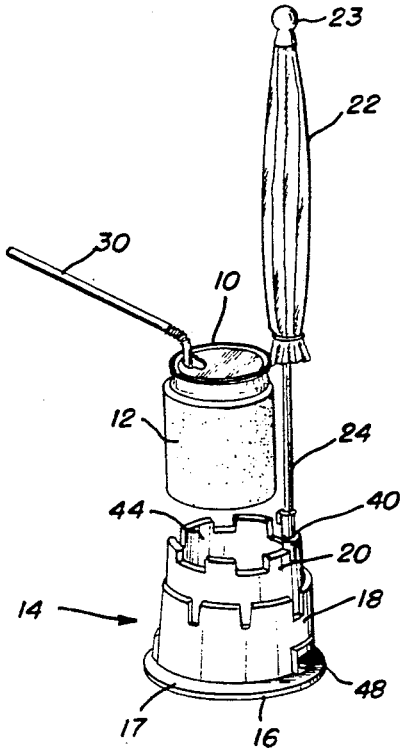
FIG. 1 is a front perspective view of the shielded beverage carrier of the present invention showing an insulated sleeve removed from its support housing.

Referring in general to FIGS. 1 through 5, the present invention includes a beverage can 10 housed within an insulated sleeve 12 of any known type. These insulated sleeves are often known as a "huggy", "cool cup", or "cool can" and are designed to slide around a can for maintaining the same in a somewhat insulated and chilled condition.

A primary support member or housing 14 is provided which includes a wide support base 16 defining a flange portion 17 in connection therewith. The support base may either be formed of a material consistent with that of the remaining support housing 14 or may be formed of a styrofoam buoyant material. Also provided in connection with the primary support housing is a first decorative tier 18 and a second decorative tier 20. The tiered nature of the primary support housing in combination with its flanged support base 16 enables a stable configuration in which to house the can and insulated sleeve 10, 12, respectively. Further, in order to add stability to the support member, at least the lower tier 18 may be weighted. An inner wall 44 of the support 14 is of a circumference great enough to easily house the insulated sleeve 12 having a can 10 therein. Insertion and removal of the insulated sleeve 12 and can 10 into the support 14 may be accomplished without undue force, the support 14 merely providing a stable housing for the insulated sleeve and can 10.

Figure 5:
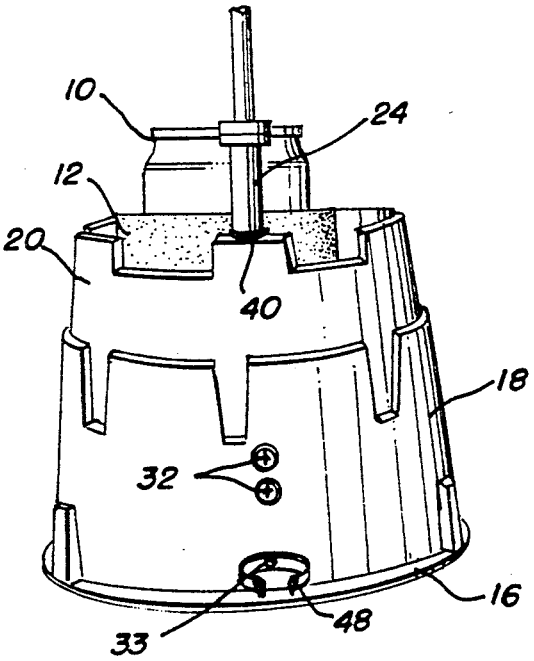
FIG. 5 is an enlarged view of the support housing and connection of the umbrella shaft therewith shown in FIG. 1.

An umbrella 22 is removably anchored within a fitting or aperture 40 positioned at an upper periphery of the second decorative tier 20 as most clearly shown in FIG. 5. The umbrella 22 includes a lower shaft portion 24 and an upper shaft portion 26, the upper shaft portion 26 being rotatably and angularly pivotable with respect to the lower shaft portion 24 by a hinge connection 28 of any suitable type. The umbrella 22 may then be adjusted to shade against the sun which may be heating the insulated beverage. For example, the hinge 28 may be of a ball and socket type arrangement, a bi-directional hinge, or the like which enables positioning of the umbrella 22 at any desired angle whereby the umbrella will remain fixed at that position until further movement thereof. As primarily seen in FIG. 2, the hinge 28 enables the upper umbrella shaft 26 to be folded in a storage position against the lower umbrella shaft 24. In this storage position, the top 23 of the umbrella 22 may be securely clipped to the support housing 14 by a clamp 48 attached adjacent a base of the first decorative tier 18 by means of a screw 33 or the like. The clamp 48 is shown in greater detail in FIG. 5. The awning portion of the umbrella is of a sufficient diameter to shade the entire surface of the primary support housing 14.

Referring again to FIG. 5, the lower shaft 24 of the umbrella is fixed to the primary support housing 14 by means of screws 32 within the first tier 18. In other words, the lower umbrella shaft 24 is of a sufficient length to extend nearly to the support base 16 and is anchored to the first tier at 32 in a stable manner.

Figure 3:
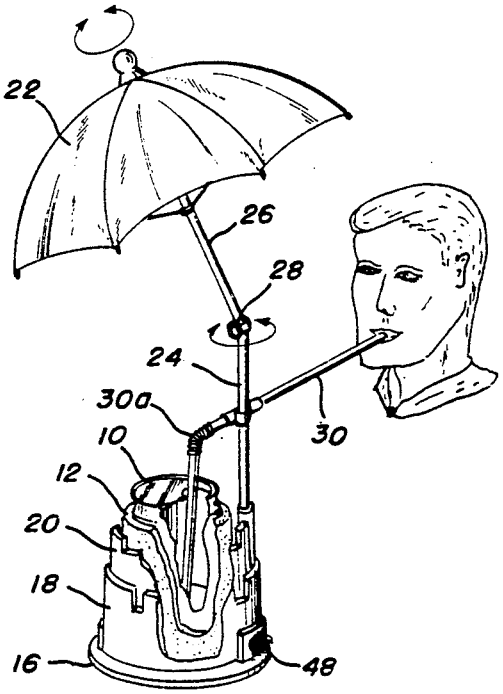
FIG. 3 is a front partially cut-away view of the shielded beverage carrier shown in FIG. 1 with the umbrella extended.
Figure 4:
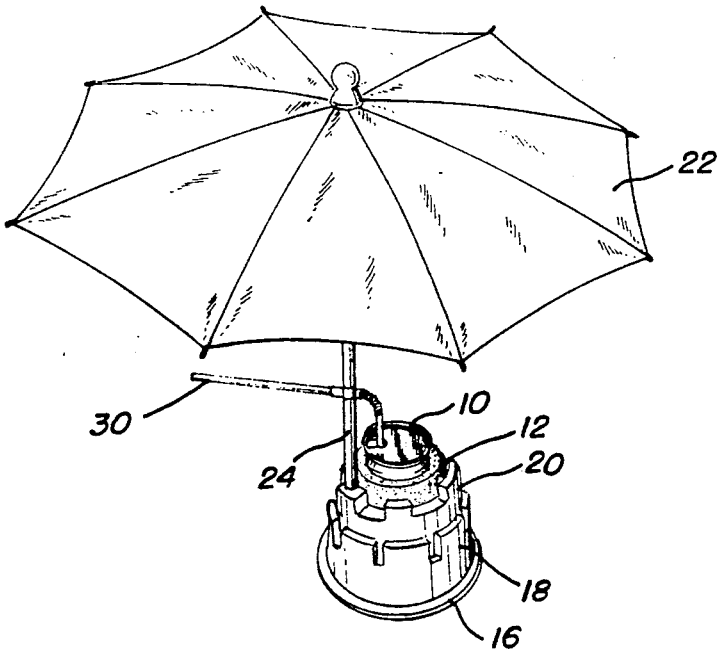
FIG. 4 is a top perspective view of a shielded beverage carrier according to the present invention with the umbrella opened.

FIG. 3 clearly shows that the insulated sleeve 12 fits securely within inner wall 44 of support housing 14 and all the way to the base 16 thereof so that the insulated sleeve 12 is nearly engulfed by the support housing 14.

Figure 10:
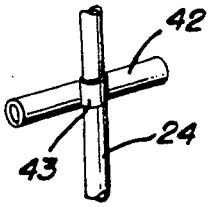
FIG. 10 is an enlarged view of a straw and pole connection assembly for any of the embodiments shown.

FIG. 3 shows a straw 30 provided in connection with the support housing 14 and lower umbrella shaft 24. As seen from the Figures, the straw 30 is a long and flexible tubular device to assist in dispensing of the beverage, even in a reclined position of the user. Further, due to the flexible nature of the straw, it may easily be inserted and removed from the beverage container without detaching the straw from the lower umbrella shaft 24. Positioning of the straw 30 is of particular importance to enable consumption of the beverage while in a relaxed or reclined position. The straw used must be of a type which is flexible through at least a portion thereof such as shown at 30*a* in FIG. 3 so that a lower portion of the straw may be positioned within the can 10 and a distal end of the straw will reach to the user's mouth as shown in FIG. 3. Attachment of the straw to the lower umbrella shaft 24 may be by any suitable means including a pre-formed tubular sleeve 42 which slides around the umbrella shaft by a band element 43 with the tubular sleeve 42 passing to one side of the lower shaft 24. This particular arrangement is shown in detail in FIG. 10. Alternatively, the straw may be attached to the umbrella shaft by means of any suitable gripping device, or may be threaded through a minute aperture within the shaft 24 thereby fixing the straw in place. An advantage of the tubular sleeve 42 is that the wraparound band element 43 may slide up and down the lower umbrella shaft 24 to position the distal end of the straw 30 at any suitable height for consumption of the beverage by the user.

Figure 7:
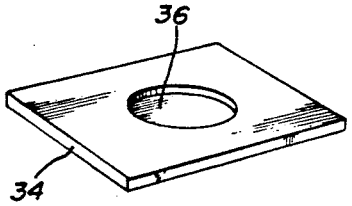
FIG. 7 is a floatable base member for lending additional stability and floatation to the embodiment shown in either of FIG. 1 or FIG. 4.
Figure 2:
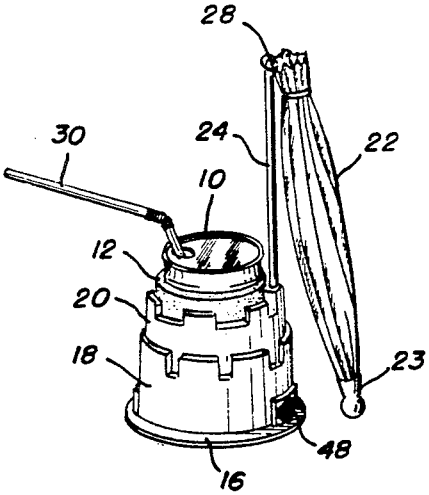
FIG. 2 is a front perspective view of the shielded beverage carrier shown in FIG. 1 with an umbrella thereof in a folded position.
Figure 6:
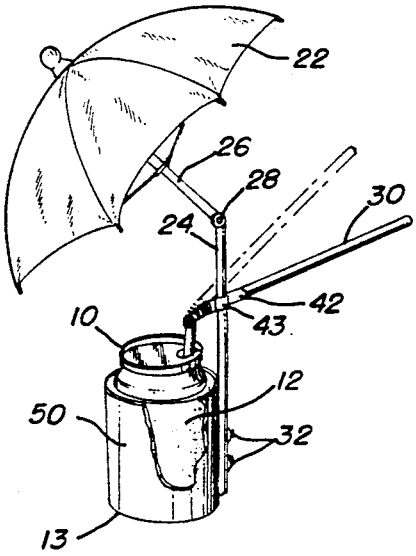
FIG. 6 is a front perspective view of a second embodiment of the shielded beverage carrier of the present invention.
Figure 8:
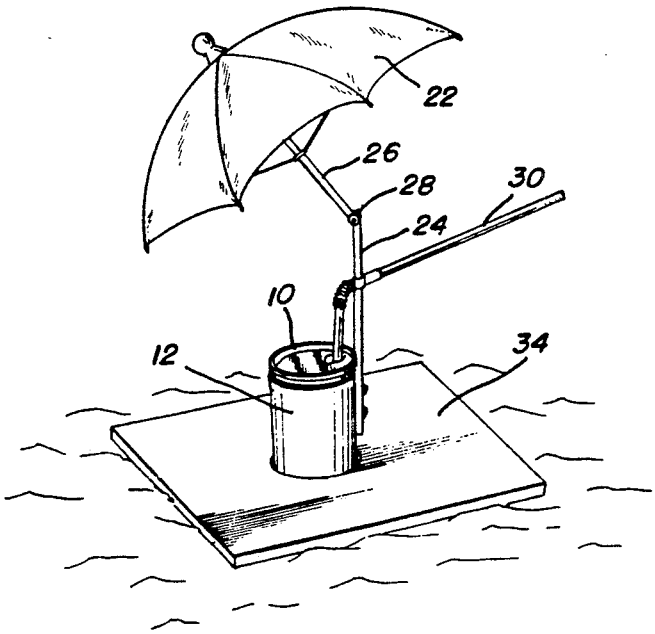
FIG. 8 is a perspective view of the second embodiment in the floatable base member.

Referring now to FIGS. 6 through 8, there is shown a second embodiment of the present invention of a smaller handheld version in which the lower umbrella shaft 24 is fixed directly to the insulated sleeve 12 by screws 32 or the like as most clearly shown in FIG. 5. Instead of the tiered support housing 14, there is provided a thin plastic shell 50 surrounding the insulated sleeve 12. The shell 50 may either be a coating applied to the sleeve 12 or a separate housing from which the sleeve may be removed. Remaining features including the adjustability of the umbrella 22, and the nature of and attachment of the straw 30 to the lower umbrella shaft 24 are identical to the description above in connection with the first embodiment and will not be repeated here for the sake of brevity.

Figure 9:
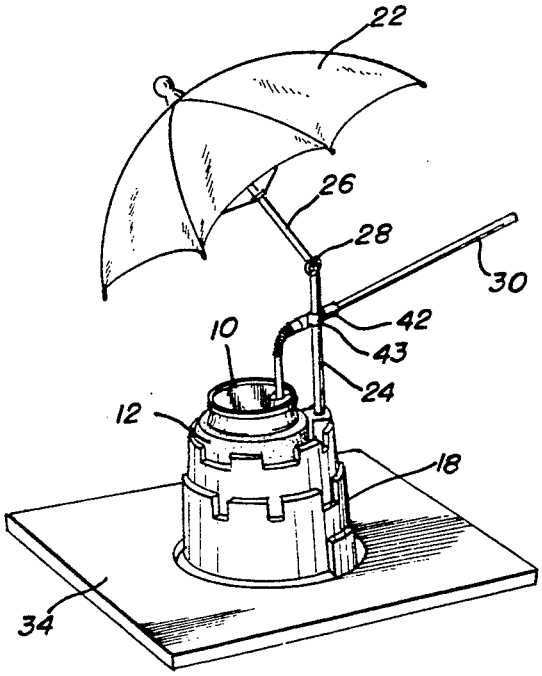
FIG. 9 is a perspective view of the first embodiment in the floatable base member.

In FIG. 7, there is shown a rectangular support base 34 of a dimension to suitably stabilize the insulated sleeve 12. Provided within the rectangular base 34 is an aperture 36 into which a base end 13 of housing 50 will fit and into an enlarged opening of Which the base 16 of tiered support housing 14 will also fit as shown in FIG. 9.

A combination of either shell 50 or housing 14 fitted within the rectangular floatation device 34 provides a beverage station suitable for use in an aquatic environment.

Accordingly, the present invention achieves a unique feature of shading beverage cans from the warming of sun while making consumption easier from an awkward position by the user. A beverage may be consumed in various positions, such as those positions common to sun bathing including lying on a persons stomach or sitting in a beach chair. This makes drinking possible without removing the beverage from the primary support housing 14. It also makes consumption possible without sitting up or rolling over. Alternatively, the straw attachment need not be used, and the can 10 in combination with the insulated sleeve 12 may be removed from the housing 14 in order to drink the beverage straight from the can 10. During period of nonconsumption, the drink can be replaced in the support housing 14 to shade it from the sun.

As indicated, the base 16 and first decorative tier 18 are weighted to give greater stability and thereby prevent overturning of the device.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

I claim:

1. A shielded beverage carrier, comprising:

an insulated sleeve for accommodating a beverage receptacle therein;

a support housing for receiving said insulated sleeve therein, said support housing including an inner wall corresponding to an exterior shape of said insulated sleeve;

an umbrella including a support shaft, said support shaft being anchored to said support housing; and means for dispensing a beverage from the beverage receptacle, said means for dispensing being secured to at least a portion of said umbrella shaft.

2. The shielded beverage carrier according to claim 1, wherein said support housing includes a flanged base portion, a tiered exterior shell portion integrally formed with said base portion, and an aperture formed within said exterior shell portion for supporting said umbrella support shaft.

3. The shielded beverage carrier according to claim 1, wherein said support shaft includes a first pole section insertable within a selected portion of said support housing, and a second pole section pivotably mounted to said first pole section, wherein said umbrella is collapsible onto said second pole section and expandable to shade said insulated sleeve and support housing.

4. The shielded beverage carrier according to claim 1, wherein said means for dispensing is a straw member removably fitted at a midway portion thereof to the first pole section, thereby fixing the straw member in a predetermined position.

5. The shielding beverage carrier according to claim 4, wherein said first pole section includes an aperture formed therethrough and wherein the straw member is threaded through the aperture.

6. The shielded beverage carrier according to claim 4, wherein said first pole section includes a slidable fitting mounted thereon and wherein the straw member is secured to said first pole section with the slidable fitting.

7. A floatation beverage carrier comprising:

an insulated sleeve for accommodating a beverage receptacle therein;

an umbrella supported by and anchored to said insulated sleeve, said umbrella including a first pole section connected to said insulated sleeve and a second pole section foldable against said first pole section for storage thereof, and means for adjusting the second pole section with respect to the first pole section;

a straw member adjustably mounted to said first pole member, wherein one portion of said straw member is in communication with said beverage receptacle and another portion of said straw member is accessible by a user for dispensing a beverage from said beverage receptacle;

a support member having an aperture formed therein for receiving said insulated sleeve; and a floatable base raft having at least a widthwise dimension corresponding to a widthwise dimension of said support member, whereby said support member maintains said insulated sleeve containing said beverage receptacle in an upright orientation with respect to said floatation base.

* * * * *